US006203187B1

(12) United States Patent
Abbasi et al.

(10) Patent No.: US 6,203,187 B1
(45) Date of Patent: Mar. 20, 2001

(54) METHOD AND APPARATUS FOR CONTROLLED MIXING OF FLUIDS

(75) Inventors: Hamid Ali Abbasi, Darien; Iosif Khaim Rabovitser, Skokie; John Charles Wagner, La Grange, all of IL (US)

(73) Assignee: Institute of Gas Technology, Des Plaines, IL (US)

( * ) Notice: Subject to any disclaimer, the term of this patent is extended or adjusted under 35 U.S.C. 154(b) by 0 days.

(21) Appl. No.: 09/130,288

(22) Filed: Aug. 6, 1998

(51) Int. Cl.[7] ..... B01F 15/02; B01F 15/04

(52) U.S. Cl. ..... 366/167.1; 366/173.1; 366/182.4; 137/3

(58) Field of Search ..... 366/182.4, 106, 366/160.1, 160.5, 162.1, 167.1, 173.1; 137/3, 9

(56) References Cited

U.S. PATENT DOCUMENTS

| | | | |
|---|---|---|---|
| 3,583,446 | | 6/1971 | Rush, Jr. . |
| 3,734,111 | | 5/1973 | McClintock . |
| 4,176,671 | | 12/1979 | Citrin . |
| 4,257,533 | | 3/1981 | Matsuyama et al. . |
| 4,390,346 | | 6/1983 | Cramer et al. . |
| 4,521,117 | | 6/1985 | Ouwerkerk et al. . |
| 4,624,836 | | 11/1986 | Cartmell et al. . |
| 4,711,766 | | 12/1987 | Cartmell et al. . |
| 4,779,545 | | 10/1988 | Breen et al. . |
| 4,808,382 | | 2/1989 | Cartmell et al. . |
| 4,824,557 | | 4/1989 | Cartmell et al. . |
| 5,351,892 | | 10/1994 | Conte . |
| 5,480,597 | * | 1/1996 | Ishida et al. . |
| 5,490,726 | * | 2/1996 | Davis et al. . |
| 5,500,050 | | 3/1996 | Chan et al. . |

FOREIGN PATENT DOCUMENTS

| | | |
|---|---|---|
| 842040 | 7/1960 | (GB) . |

* cited by examiner

*Primary Examiner*—Tony G. Soohoo
(74) *Attorney, Agent, or Firm*—Pauley Petersen Kinne & Fejer

(57) ABSTRACT

A method for mixing fluids in which a continuously variable flow rate stream of an injection fluid is introduced into a substantially constant flow rate stream of a primary fluid in a direction substantially transverse with respect to the direction of flow of the substantially constant flow rate stream of the primary fluid.

10 Claims, 5 Drawing Sheets

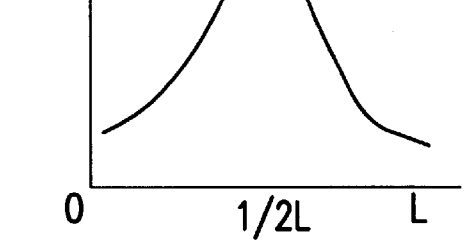
FIG.1A
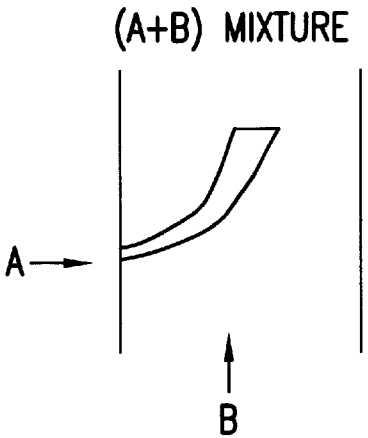
FIG.1B
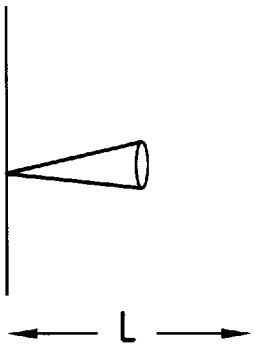
FIG.1C
FIG.1D

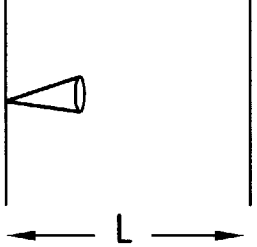
FIG.2A
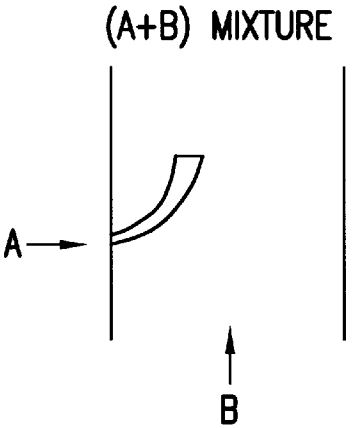
FIG.2B
FIG.2C
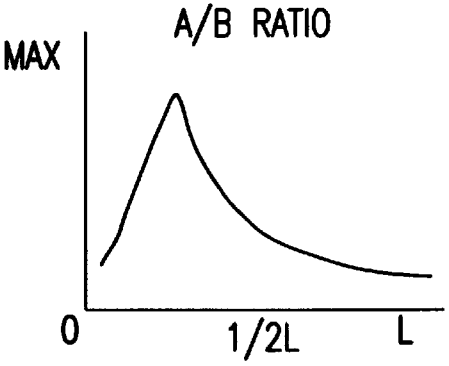
FIG.2D

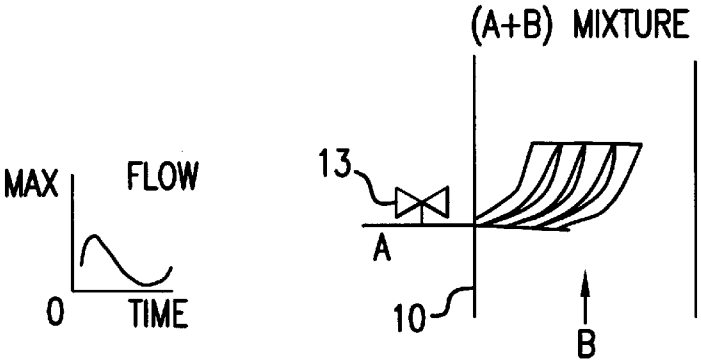
FIG.3A
FIG.3B
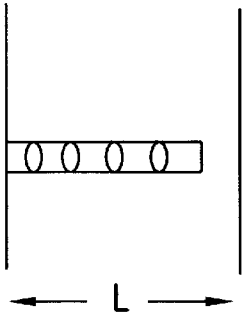
FIG.3C
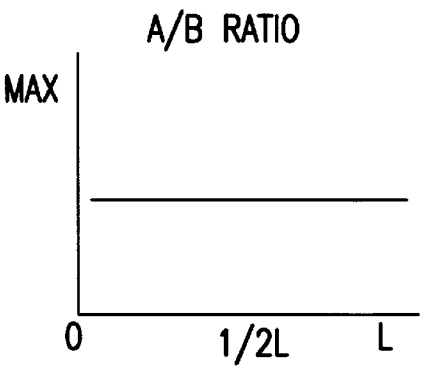
FIG.3D

METHOD AND APPARATUS FOR CONTROLLED MIXING OF FLUIDS

BACKGROUND OF THE INVENTION

1. Field of the Invention

This invention relates to a method and apparatus for controlled mixing of two or more fluids. More particularly, this invention relates to a method and apparatus for controlled mixing of two or more fluids in which a second fluid stream is introduced into a first fluid stream in a manner which provides rapid and intimate mixing of the fluids or, alternatively, selective mixing of the fluids.

2. Description of Prior Art

There exist many applications which require rapid and intimate mixing of two or more fluids. This is generally accomplished by one or more of the following techniques: (1) using the kinetic energy of the fluids to force the mixing; (2) use of a static mixer installed in the mixture flow stream; and (3) use of a dynamic mixer installed in the mixture flow stream. A wide variety of both static and dynamic types of mixtures are available on the market. Kinetic mixing is generally accomplished by injecting a continuous lower flow rate fluid into a continuous larger flow rate fluid through strategically placed nozzles.

In many applications, for example when mixing a solid, liquid or gaseous fuel and an oxidant prior to combustion, or when mixing fuels and/or oxidants with products of partial or complete combustion, static and dynamic mixers are impractical. In the case of fuel/oxidant mixing prior to combustion, the use of static and dynamic mixers increases the potential for flashback as well as its severity, a highly undesirable consequence. In the case of mixing fuel and/or oxidant with the combustion products to change the combustion stoichiometry and/or to complete combustion, the use of static or dynamic mixers is also impractical because this requires placement of a relatively large component, namely the in-line mixer, into the combustion products.

Most combustion applications require mixing of two fluids with substantially different flow rates as well as other properties. For example, in combustion applications employing premixed fuel and oxidant, the fuel, for example, natural gas, must be mixed with oxidant, for example, air, in proportions of about 1:10 in order to obtain stoichiometric combustion. Similarly, for applications requiring the injection of a fuel into the combustion products, such as gas reburning, or applications that require injection of an oxidant into the combustion products, for example, secondary and/or tertiary combustion air in staged combustion, the injected fluid is only a small fraction of the total volume of the combustion products. In all of these applications, difficulty arises from the need to simultaneously provide both distribution and penetration of the injected fluids so as to provide rapid and uniform mixing. One solution to the problem of disparate volumes and flow rates of an injected fluid and a fluid being injected into is the use of carrier fluids, that is, the mixing of the injected fluid with an additional fluid (the carrier fluid) prior to injection. In the case of injection of a fuel into a stream of combustion products, for example, nitrogen or steam or recirculated flue gases may be employed as a carrier fluid. This, of course, requires additional equipment by the user.

Other applications require selective mixing of fluids. For example, if a first fluid, such as combustion products, has a non-uniform (or unsteady) oxygen profile which needs to be made uniform (or steady) by mixing it with a fluid containing a fixed level of oxygen, then the most effective way to achieve the uniform profile of oxygen in the combustion product is to selectively inject the oxygen-containing fluid into the combustion product, that is, injecting more oxygen-containing fluid where or when the oxygen concentration in the combustion product is lower than desired and less oxygen-containing fluid where or when the oxygen concentration in the combustion products is higher than desired. Similarly, in some applications, controlled mixing may be necessary to provide a certain profile of a particular parameter, for example, species concentration, temperature, etc., in the resulting mixture. Conventional mixers can be designed to provide a certain level of mixing for a fixed ratio of flow of two streams, but the adequacy of the mixing decreases as the ratio is varied. U.S. Pat. No. 4,779,545 teaches a method and apparatus for reducing $NO_x$, emissions from furnace flue gas in which natural gas or another fluid having no fixed nitrogen is introduced in pulses, that is discontinuous injections, into the upper portion of the furnace so as to obtain a desired form of mixing.

Related U.S. Pat. Nos. 4,824,557; 4,808,382; 4,711,766; and 4,624,836 all relate to a plug valve for providing immediate and intimate mixing of fluidizable cracking catalysts with fluid hydrocarbons in a riser reactor. The plug valve comprises a generally hollow tubular plug stem having a hollow plug secured thereto. The plug is engageable with the riser reactor access opening and movable in a reciprocating fashion to permit and control the flow of fluidizable cracking catalysts to the riser reactor. U.S. Pat. No. 4,521,117 teaches an arrangement for mixing a first gas into a main flow of a second gas comprising a main conduit for the main flow and a plurality of supply conduits for the first gas which open into the main conduit. The supply conduits are arranged as at least one set of three outlet openings, the first opening of which opens into the main flow perpendicular to the main conduit wall, and the remaining openings of which are arranged so as to provide a lesser flow rate of the first gas than the first opening and are offset with respect to the first opening. The three openings of the set thus direct the first gas into two contra-rotating circulatory movements as viewed in the direction of the axis of the main conduit.

An apparatus for mixing one or more gases into a main flow of gas in a cylindrical conduit through one or more feed conduits is taught by U.S. Pat. No. 4,390,346. The feed conduits are provided with two openings for outflow of the added gas, which openings are spaced from the wall of the cylindrical conduit, are symmetrically located with respect to the axis of the cylindrical conduit, and lie in a plane perpendicular to that axis. The axes of these openings are mutually spaced by less than one-half of the internal diameter of the conduit. The added gas emerges from the two openings in mutually opposite parallel directions so that it tends to circulate around the axis.

Finally, U.S. Pat. No. 3,734,111 teaches a method and apparatus for mixing a fluid traveling in a pipe section with a second fluid introduced into the pipe section by sparging the second fluid into the pipe section at points across the internal diameter of the pipe section, disrupting the flow through the pipe section with a perforated frusto-conical baffle coaxially aligned with the pipe section with its apex extending toward the means of sparging the second fluid, sparging additional second fluid downstream from within the flow of the frusto-conical baffle, and disrupting the flow within the pipe downstream of the frust-conical baffle and sparging means with a line restriction extending from the pipe section sidewalls into the pipe section to create an orifice of smaller diameter than the pipe section inside diameter coaxially aligned with the pipe sections. None of these methods are suitable for selective mixing of fluids, nor are they particularly suitable for applications requiring mixing of two fluids of substantially different flow rates.

SUMMARY OF THE INVENTION

Accordingly, it is one object of this invention to provide a method for rapid and intimate mixing of two or more fluids where the two fluids to be mixed have substantially different flow rates and other properties.

It is another object of this invention to provide a method for rapid and intimate mixing of two or more fluids where the fluids to be mixed have substantially different flow rates, which method obviates the need for using carrier fluids and, thus, avoids the need for additional equipment associated therewith.

It is another object of this invention to provide a method for mixing two or more fluids so as to provide a certain profile of a particular parameter and the resulting mixture, that is, selective mixing of the fluids to provide a mixture having the desired characteristics.

These and other objects of this invention are achieved by a method for mixing fluids comprising the steps of introducing a rapidly continuously variable flow rate stream of a lower flow injection fluid or fluids into a substantially nonvariable (or constant) flow rate stream of a higher flow primary fluid in a direction substantially transverse with respect to the direction of flow of the substantially constant flow rate stream of primary fluid. Rapidly varying the flow rate of the injected fluid or fluids continuously changes the extent of penetration of the injection fluid into the primary fluid stream, creates a controlled profile of mixing, and increases the turbulent mixing of the fluids. This is accomplished by installing any suitable flow control device in the supply line of the injected fluid having the capability of rapidly varying the flow rate of the injected fluid. Such devices include electro-mechanical valves which are operable over a range of openings between fully open and fully closed and the like. One method of controlling the discharge of a fluid is taught, for example, by U.S. Pat. No. 4,176,671 which discloses a valve having a drive element disposed to pinchingly engage a collapsible tube at a high reciprocating speed. A method of discharging slurries by varying valve openings is taught by U.S. Pat. No. 4,257,533, and U.S. Pat. No. 5,500,050 teaches a chemical dispenser controller that automatically learns the chemical feed rate of whatever chemical dispenser it is coupled to and then uses that learned feed rate information to dispense chemicals so as to reach a specified concentration or quantity dispensing target quickly without overshooting the specified target.

BRIEF DESCRIPTION OF THE DRAWINGS

The objects and features of this invention will be better understood from the following detailed description taken in conjunction with the drawings wherein:

FIGS. 1A–1D are diagrams showing the effect of constant high flow rate injection of an injection fluid (A) into a constant flow rate primary fluid stream (B);

FIGS. 2A–2D are diagrams showing the effect of constant low flow rate injection of the injection fluid into a constant flow rate primary fluid stream;

FIGS. 3A–3D are diagrams showing the effect of continuous flow rate variation of the injection fluid;

DESCRIPTION OF PREFERRED EMBODIMENTS

Figure 4A:
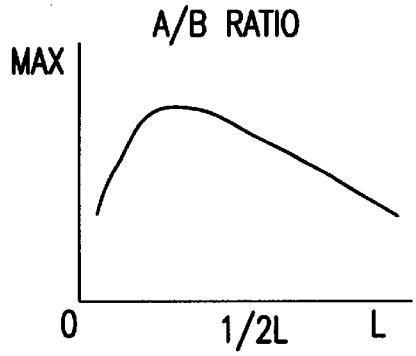
FIGS. 4A–4C are diagrams showing the effect of varying the shape of the flow rate wave of the injection fluid.
Figure 4B:
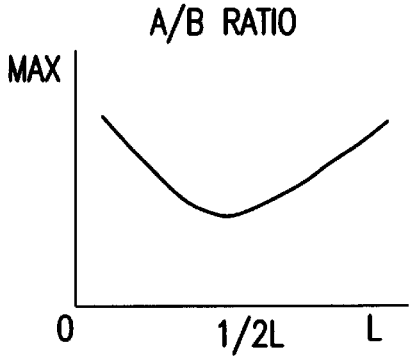
Figure 4C:
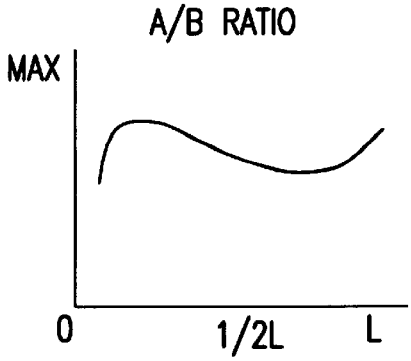

The method of this invention for mixing fluids comprises the steps of introducing a rapidly varying flow rate stream of an injection fluid into a substantially constant flow rate stream of a primary fluid in a direction substantially transverse with respect to a direction of flow of the substantially constant flow rate primary fluid stream. The method can be used to vary the penetration of the injection fluid jets, to create a controlled spatial and/or temporal profile of mixing, and to increase the turbulent mixing. This is accomplished by installing in the supply line of the injection fluid any suitable device having the ability to rapidly vary the flow rate of the injection fluid. Thus, for the same time averaged flow rate, when the flow control device is open to the maximum degree, the injection fluid is injected at a higher velocity (momentum) than at a steady flow rate, thereby varying both the penetration and the turbulent mixing. The degree of mixing is controlled by changing the cyclic frequency and/or the shape of the flow rate wave as well as by further varying these two parameters with time, either in a regular or random fashion. In accordance with one preferred embodiment of this invention, the flow rate of the injection fluid is varied in a range of about 0.1 to about 500 cycles per second, and most preferably in a range of about 1 to about 200 cycles per second. The method can be applied to simple injection fluid nozzles or specially designed nozzles that are used to impart a specific shape to the injected fluid jets. In addition, the method of this invention can be applied to a wide range of fluids as well as fluid/solid mixtures. Thus, in accordance with one embodiment of this invention, both the injection fluid and the primary fluid are gaseous fluids. In accordance with another embodiment of this invention, at least one of the fluids, the primary fluid and/or the injection fluid, comprises solid particles. In accordance with yet another embodiment of this invention, a plurality of injection fluids are injected into the substantially constant flow rate primary fluid stream.

Although applicable to a wide range of processes requiring the mixing of two or more fluids, the method of this invention is particularly suitable for use in connection with combustion applications where mixing of the fuel and oxidant prior to combustion or mixing the fuel and/or oxidants with products of partial or complete combustion is employed. Most combustion applications require mixing of two or more fluids with substantially different flow rates and other properties. For example, in order to premix natural gas and oxidant, the proportions of the mixture required to provide stoichiometric combustion are ten parts of oxidant, for example, air, to one part of natural gas. Similarly, in combustion applications that require the injection of one or more fluids into the combustion products, such as for reburning, secondary and/or tertiary air in staged combustion, and flue gas recirculation to control $NO_x$ emissions, the injected fluid is typically only a fraction of the flow rate of the primary combustion products. In all of these applications, difficulty arises from the need to simultaneously provide both coverage and penetration of the injected fluid to provide rapid and uniform mixing. As shown, for example, in FIGS. 1A–1D, for a given flow rate, penetration of fluid A into fluid stream B is to a set point within fluid stream B and produces a profile of mixing across the expanse of fluid stream B (L) designated as A/B Ratio, with the major portion of fluid A disposed, in the example shown, in the central portion of fluid stream B. For a reduced flow rate as shown in FIGS. 2A–2D (compared to FIGS. 1A–1D), penetration of fluid A into fluid stream B is reduced and the profile of mixing is skewed toward the entry point of fluid A into fluid stream B. It will be apparent to those skilled in the art that in order to provide the same volume of fluid A in fluid stream B at a lower flow rate as shown in FIGS. 2A–2D compared to the higher flow rate shown in FIGS. 1A–1D, more input devices, that is nozzles or similar devices, will be required. As is clearly shown by FIGS. 1A–1D and 2A–2D, uniform mixing of fluid A in fluid stream B is not achieved.

FIGS. 3A–3D shows the mixing profile resulting from introduction of fluid A into fluid stream B by rapidly continuously varying the flow rate of fluid A in accordance with this invention. As can be seen, mixing of fluid A with fluid stream B produces uniform mixing across the expanse L of fluid stream B for a rapidly varying flow rate of fluid A at a constant frequency of variation.

In addition to providing rapid, uniform and intimate mixing of two or more fluids, the method of this invention can also be used in applications requiring selective mixing of fluids. For example, in combustion applications, if a primary fluid, such as combustion products, has a non-uniform or unsteady oxygen profile which needs to be made uniform or steady by mixing it with an injection fluid containing a fixed level of oxygen, the most effective way to achieve the uniform profile of oxygen in the primary fluid is to selectively inject the injection fluid into the primary fluid. That is, wherever or when the oxygen concentration in the primary fluid is too low, more injection fluid is injected into the primary fluid; and wherever or when the oxygen concentration in the primary fluid is high, lesser amounts of injection fluid are injected into the primary fluid. Similarly, certain processes may require controlled mixing to provide a certain profile of a particular parameter, for example species concentration or temperature, in the resulting mixture. While conventional mixers can be designed to provide a certain level of mixing for a fixed rate of flow of two streams, the adequacy of the mixing decreases as the ratio is varied. When rapidly varying the flow rate of the injection fluid in accordance with the method of this invention, the duty cycle can be varied to achieve optional mixing for every flow rate.

Figure 5:
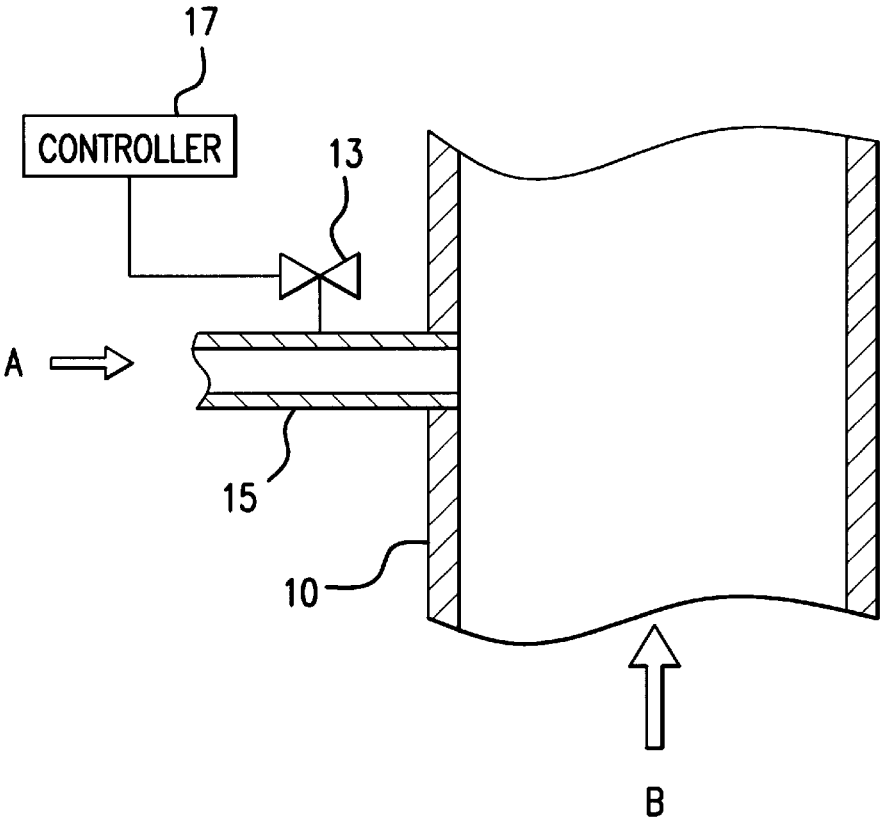
FIG. 5 is a diagram of a system for implementation of the method of this invention.

In order to effectuate the rapid flow rate variations of the injection fluid in accordance with the method of this invention, a flow varying device 13, as shown in FIG. 5, is inserted into the supply line of the injection fluid. In accordance with a particularly preferred embodiment of this invention, the flow varying device is an electro-mechanical valve having the capability of rapidly varying the flow rate of the injection fluid. Changing flow rates is accomplished through a controller 17 which is operatively connected to flow varying device 13. Controllers suitable for this purpose are known to those skilled in the art. In accordance with one embodiment, the electro-mechanical valve is of the type that is operational between fully open and fully closed. In order to control the mixing profile, in accordance with one embodiment of this invention, the frequency of the variations in flow rate of the injection fluid is changed. For low frequency variations, the degree of mixing between injection fluid (A) and primary fluid (B) is less than the degree of mixing achieved by increasing the variations in frequency of the injection fluid (A). FIGS. 4A–4D show exemplary mixing profiles which can be achieved by changing the frequency of variations of the flow rate of fluid A into fluid stream B.

An apparatus for implementation of the method of this invention comprises a first fluid stream flow chamber formed by wall 10 (See FIG. 5), second fluid flow means for injection of a second fluid into the first fluid stream flow vessel in a direction substantially transverse to a direction of flow of a first fluid stream flowing through the first fluid stream flow chamber, for example nozzles 15, in communication with the first fluid stream flow chamber, and flow variation means for varying an injection of the second fluid into the first fluid stream chamber connected to the second fluid flow means. In accordance with one embodiment, the flow variation means comprises an electro-mechanical valve, as symbolized by element 13 in FIG. 5. The electro-mechanical valve 13 is in operative communication with controller 17 which controls the opening and closing of valve 13 in response to an input regarding a desired mixing profile.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In a chamber through which a substantially constant flow rate stream of a first fluid is flowing, a method for mixing fluids comprising the steps of:

introducing at least one continuously varying flow rate stream of at least one second fluid into said substantially constant flow rate stream of said first fluid in a direction substantially transverse with respect to a direction of flow of said substantially constant flow rate stream of said first fluid.

2. A method in accordance with claim 1, wherein a flow rate of said second fluid is varied in a range of about 0.1 to about 500 cycles per second.

3. A method in accordance with claim 2, wherein said flow rate of said second fluid is varied in a range of about 1 to about 200 cycles per second.

4. A method in accordance with claim 1, wherein a plurality of said second fluids are injected into said substantially constant flow rate stream.

5. A method in accordance with claim 1, wherein at least one of said first fluid and said at least one second fluid comprises solid particles.

6. A method in accordance with claim 1, wherein a degree of mixing of said first fluid and said second fluid is controlled by altering a cyclic frequency of flow variations of said at least one continuously varying flow rate stream of said second fluid.

7. A method in accordance with claim 1, wherein a degree of mixing of said first fluid and said at least one second fluid is controlled by altering a shape of a flow variation of said at least one second fluid as defined by a pattern of flow rate waves.

8. A method in accordance with claim 1, wherein a degree of mixing of said first fluid and said at least one second fluid is controlled by varying both a cyclic frequency and a shape of a flow rate wave of a flow variation of said at least one second fluid.

9. A method in accordance with claim 8, wherein at least one of said cyclic frequency and said flow rate wave shape are varied in a regular fashion.

10. A method in accordance with claim 8, wherein at least one of said cyclic frequency and said flow rate wave shape are varied in a random fashion.

* * * * *